US008414114B2

(12) United States Patent
Fang et al.

(10) Patent No.: US 8,414,114 B2
(45) Date of Patent: Apr. 9, 2013

(54) SYSTEMS FOR PRIMING FLUID JETTING DEVICES

(75) Inventors: Jiandong Fang, Lexington, KY (US); Frank Anderson, Sadieville, KY (US); Audrey Dale Rodgers, Lawrenceburg, KY (US); Timothy Lowell Strunk, Georgetown, KY (US); James Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 161 days.

(21) Appl. No.: 12/948,878

(22) Filed: Nov. 18, 2010

(65) Prior Publication Data

US 2012/0127241 A1 May 24, 2012

(51) Int. Cl.
*B41J 2/175* (2006.01)
*B41J 2/18* (2006.01)
*B41J 2/165* (2006.01)

(52) U.S. Cl. ..... 347/85; 347/22; 347/28; 347/89

(58) Field of Classification Search ..... 347/22, 347/28, 85, 89
See application file for complete search history.

(56) References Cited

U.S. PATENT DOCUMENTS 7,556,367 B2 * 7/2009 Langford et al. ..... 347/89

* cited by examiner

*Primary Examiner* — Jannelle M Lebron

(57) ABSTRACT

Disclosed is a system for priming a fluid jetting device. The system includes a fluid trench configured within a fluid jetting chip of the fluid jetting device and at least one first channel fluidly coupled to the fluid trench. The at least one first channel extends vertically between the fluid jetting chip and a mounting unit adapted to support the fluid jetting chip, and is adapted to supply a priming fluid to the fluid trench. The system further includes at least one second channel fluidly coupled to the fluid trench. The at least one second channel extends vertically between the fluid jetting chip and the mounting unit, and is adapted to drain-out the priming fluid from the fluid trench. Further disclosed are systems for priming a fluid jetting device, in accordance with various embodiments of the present disclosure.

5 Claims, 8 Drawing Sheets

SYSTEMS FOR PRIMING FLUID JETTING DEVICES

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to fluid jetting devices, and more particularly, to systems for priming the fluid jetting devices.

2. Description of the Related Art

A typical fluid jetting device, such as an inkjet printhead, includes a fluid jetting chip having a nozzle plate either attached to or integrated with the fluid jetting chip that may be a thermal, piezoelectric, or mechanical jetting type of a chip. As used herein, the term fluid may relate to any type of a fluid, such as a priming solution, and the like. The fluid jetting chip is supported on a unit/substrate provided with one or more fluidic tiles. The fluid jetting device also includes one or more fluid chambers/tanks that supply a fluid to the fluid jetting chip and the nozzle plate for printing purposes.

Prior to use, a fluid jetting device needs to undergo priming in order to deliver reliable print quality and resolution. The term "priming" as used herein, refers to a critical maintenance step required to remove trapped air bubbles, which either restrict or even completely block fluid flow from being delivered to firing chambers from within a fluid jetting device in order to facilitate the fluid jetting device to operate properly without misprinting and to achieve a reliable print quality. Specifically, a fluid jetting device may be primed either during installation of a printer employing the fluid jetting device or during servicing of the fluid jetting device. In general, a disposable fluid jetting device is primed prior to sale, while a permanent or semi permanent fluid jetting device may be shipped to customers in either a dry or a primed state. A typical method for priming a fluid jetting device includes pumping of a fluid through a surface of a nozzle plate of the fluid jetting device using vacuum suction from nozzles' surface (i.e., vacuum priming), or raising fluid pressure from a fluid source (positive pressure priming), in order to remove trapped air bubbles from within the fluid jetting device.

Currently, it has been observed in the prior art that page wide fluid jetting devices (printheads) utilize narrow fluid jetting chips as very narrow print zones are required to tolerate unavoidable paper skew. However, such fluid jetting chips are more fragile and have a smaller surface area thereof than that of a usual fluid jetting chip. Accordingly, priming of the page wide printheads that employ narrow fluid jetting chips becomes difficult. Further, a narrow fluid jetting chip requires transverse fluidic fan-out to mitigate problems associated with the fabrication of a substrate of the fluid jetting chip and fluidic connections within the substrate that are coupled to one or more fluid tanks. It has been observed that fan-out micro fluidic channels associated with the available fluid jetting chip are easily inhabited by air bubbles due to their small cross sectional dimensions. At present, there is no method either disclosed or published that recites fluid recirculation through the fan-out fluidic channels. Accordingly, the aforementioned fluid jetting chip has a limited capability to remove trapped air bubbles from within the fan-out microfluidic channels.

Accordingly, there persists a need for an effective priming system for a fluid jetting device in order to overcome the drawbacks and limitations of prior art priming methods and/or systems. Specifically, there persists a need for systems for effective priming of fluid jetting devices that facilitate removal of trapped air bubbles from within the fluid jetting devices including the air bubbles entrapped within fan-out microfluidic channels of the fluid jetting devices, to achieve reliable print quality.

SUMMARY OF THE DISCLOSURE

In view of the foregoing disadvantages inherent in the prior art, the general purpose of the present disclosure is to provide systems for priming fluid jetting devices by including all the advantages of the prior art, and overcoming the drawbacks inherent therein.

In one aspect, the present disclosure provides a system for priming a fluid jetting device. The system includes a fluid trench configured within a fluid jetting chip of the fluid jetting device. The system further includes at least one first channel fluidly coupled to the fluid trench. Further, the at least one first channel extends vertically between the fluid jetting chip and a mounting unit adapted to support the fluid jetting chip. The system also includes at least one second channel fluidly coupled to the fluid trench. The at least one second channel extends vertically between the fluid jetting chip and the mounting unit. The at least one first channel is adapted to supply a priming fluid to the fluid trench and the at least one second channel is adapted to drain-out the priming fluid from within the fluid trench.

In another aspect, the present disclosure provides a system for priming a fluid jetting device that includes a fluid trench configured within a fluid jetting chip of the fluid jetting device. The system further includes at least one flow feature channel disposed adjacent to the fluid trench and adapted to be fluidly coupled to the fluid trench. Furthermore, the system includes at least one first channel fluidly coupled to the fluid trench. The at least one first channel extends vertically between the fluid jetting chip and a mounting unit adapted to support the fluid jetting chip. Additionally, the system includes at least one second channel fluidly coupled to one or more flow feature channels of the at least one flow feature channel. Further, the at least one second channel extends vertically between the fluid jetting chip and the mounting unit. The at least one first channel is adapted to supply a priming fluid to the fluid trench, and the at least one second channel is adapted to drain-out the priming fluid from within the one or more flow feature channels of the at least one flow feature channel.

In yet another aspect, the present disclosure provides a system for priming a fluid jetting device. The system includes at least one feeding member coupled to a mounting unit of the fluid jetting device. The mounting unit is adapted to support a fluid jetting chip of the fluid jetting device. The system further includes at least one first fluid channel configured within the fluid jetting device. Each first fluid channel of the at least one first fluid channel is adapted to be fluidly coupled with one or more feeding members of the at least one feeding member to receive a priming fluid. Moreover, the system includes at least one draining member fluidly coupled to the each first fluid channel to drain-out the priming fluid from within the fluid jetting device.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides priming systems for fluid jetting devices, such as inkjet printheads, to remove trapped air bubbles and/or residual fluid from within the fluid jetting devices. Specifically, the priming systems may be employed for page wide inkjet printheads. Various embodiments of the systems for priming the fluid jetting devices are explained in conjunction with FIGS. 1-10.

Figure 1:
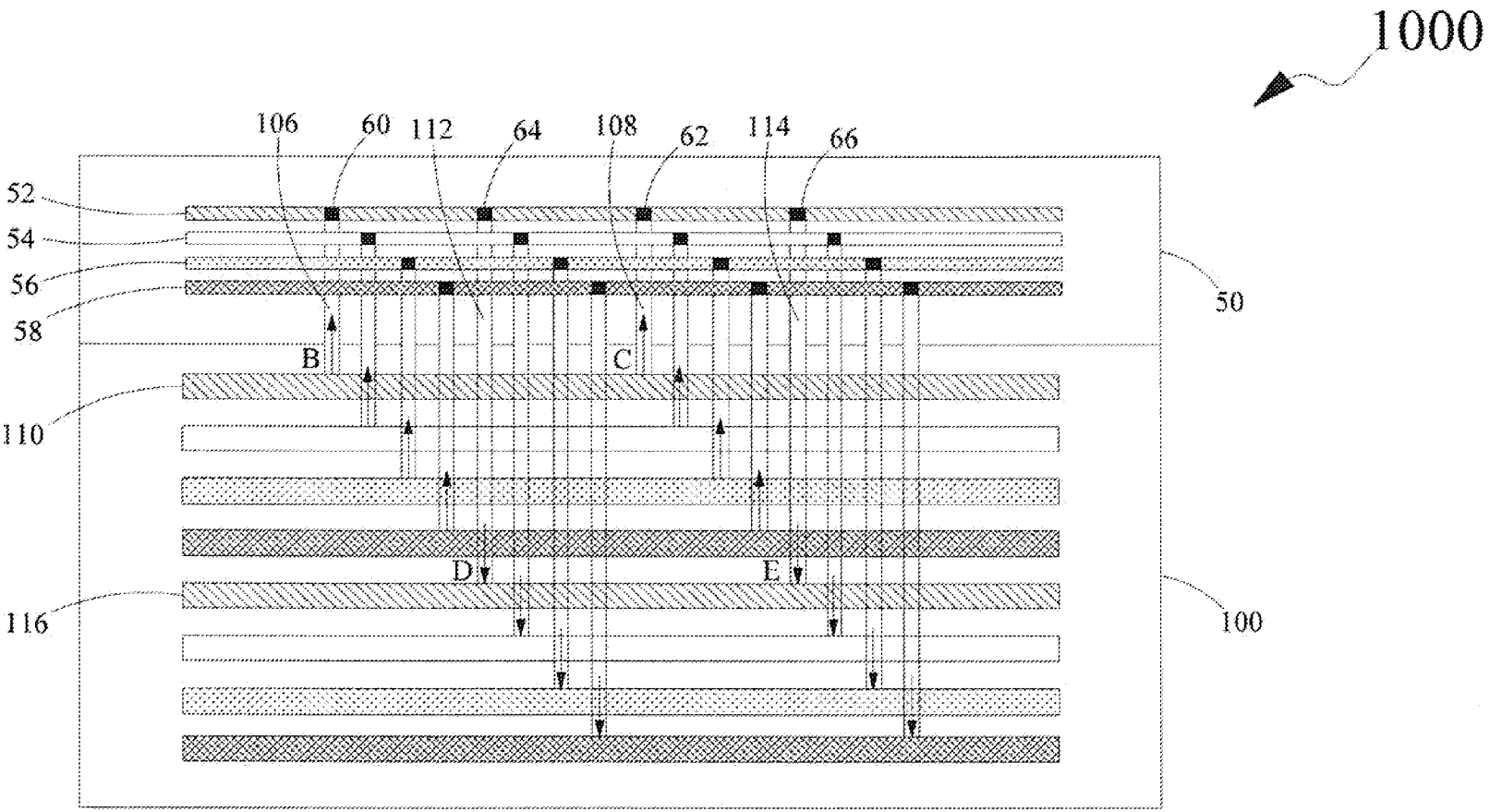
FIG. 1 illustrates a system for priming a fluid jetting device configured at a priming mode, in accordance with an embodiment of the present disclosure.
Figure 2:
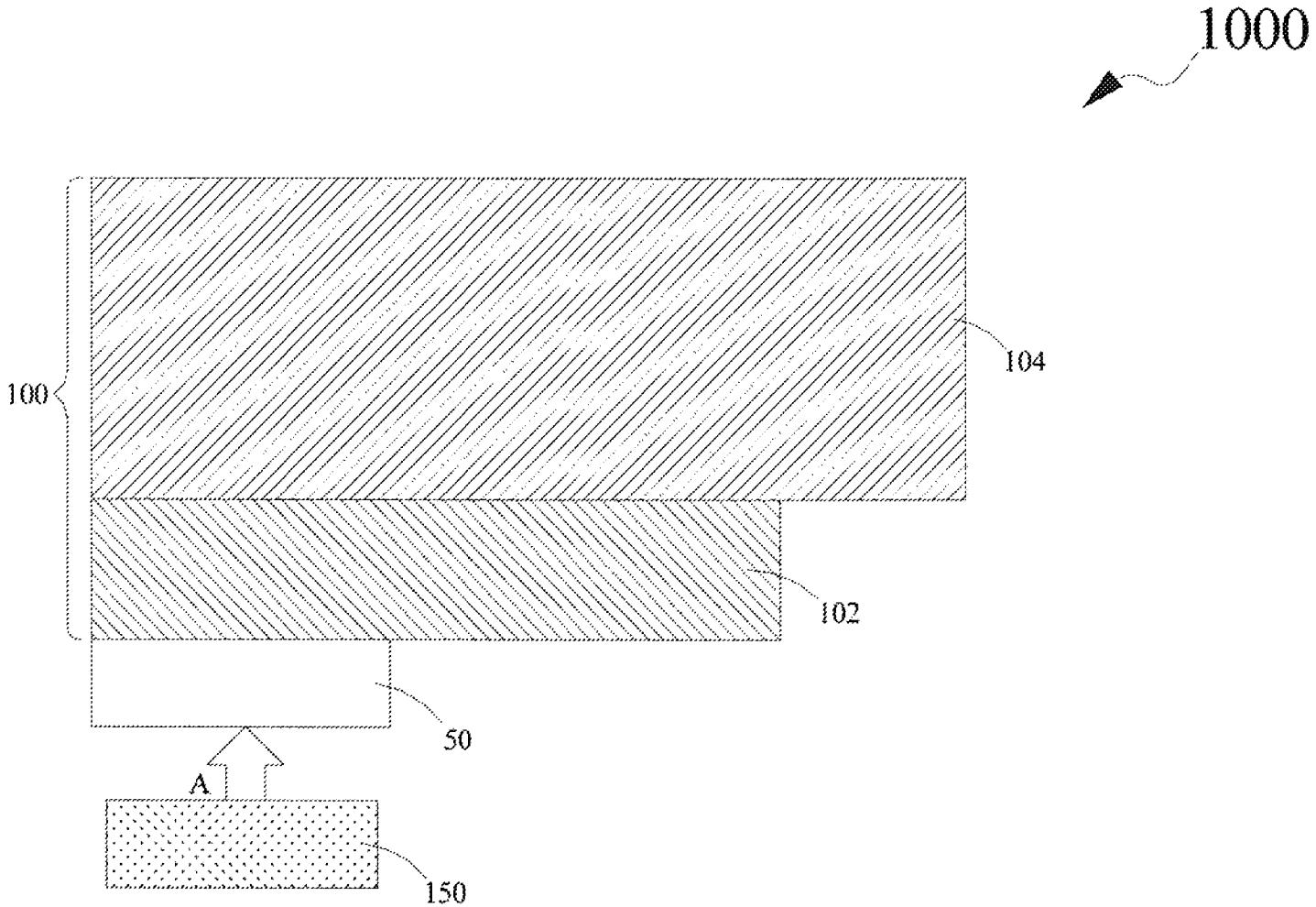
FIG. 2 illustrates an arrangement of a fluid jetting chip supported on a mounting unit within the fluid jetting device that employs the system of FIG. 1.

FIG. 1 illustrates a system for priming a fluid jetting device 1000 configured at a priming mode, in accordance with an embodiment of the present disclosure. The fluid jetting device 1000 has been depicted in FIG. 2, which shows an arrangement of a fluid jetting chip 50 supported on a mounting unit 100 within the fluid jetting device 1000. Specifically, the fluid jetting chip 50 is supported vertically on the mounting unit 100 to connect in height with the mounting unit 100. The fluid jetting device 1000 also includes a compliant layer 150 adapted to be disposed on the fluid jetting chip 50 (as shown by directional arrow "A"). The compliant layer 150 is provided for capping the fluid jetting chip 50 for priming purposes. Specifically, the complaint layer 150 is provided to seal nozzles (not shown) of a nozzle plate (not shown) configured adjacent to/on the fluid jetting chip 50 of the fluid jetting device 1000 for priming purposes. For the purpose of this description, the fluid jetting device 1000 is shown to have the fluid jetting chip 50 covered and capped by the complaint layer 150. However, it may be evident that the fluid jetting device 1000 may include an array of fluid jetting chips, such as the fluid jetting chip 50, which may be covered and capped by the compliant layer 150. Further, the fluid jetting device 1000 may be a page wide printhead. The mounting unit 100, as used herein, refers to a fluidic tile 102 (hereinafter referred to as "tile 102") and a base 104, such as a ceramic base and a liquid crystal polymer (LCP) base, attached to the tile 102. The tile 102 and/or the base 104 may include fan-out microfluidic channels (not shown) extending therefrom and fluidly coupled to the fluid jetting chip 50.

Referring again to FIG. 1, the system for priming the fluid jetting device 1000 includes a fluid trench 52 configured within the fluid jetting chip 50 of the fluid jetting device 1000. The fluid trench 52 may be for a particular fluid color, such as black. The system may also include other fluid trenches, such as a fluid trench 54, a fluid trench 56, and a fluid trench 58, for fluid colors such as blue, yellow and pink, respectively. The system may also include one or more additional trenches, such as the fluid trench 52 for the same fluid color, such as black.

Further, the system includes at least one first channel, such as a channel 106 and a channel 108, fluidly coupled to the fluid trench 52. Each channel of the channels 106, 108 may extend transversely to the fluid trench 52. Further, the channels 106, 108 extend vertically between the fluid jetting chip 50 and the mounting unit 100. Specifically, the channels 106, 108 are fan-out microfluidic channels that extend vertically from the mounting unit 100 to the fluid jetting chip 50. Furthermore, the channels 106, 108 are adapted to supply a priming fluid to the fluid trench 52 (as shown by directional arrows "B" and "C" in FIG. 1). The channels 106, 108 are also fluidly coupled to a fluid storage chamber (not shown). Specifically, a supply fluid channel 110 depicts the fluid coupling between the fluid storage chamber and the channels 106, 108. It may be evident that the channels 106, 108 may be configured to have a greater width when the channels 106, 108 are longer fan-out microfluidic channels for maintaining a uniform flow resistance. The term "priming fluid," as used herein, refers to a fluid, such as a flushing fluid, used for priming the fluid jetting device 1000.

In addition, the system includes at least one inlet port, such as an inlet port 60 and an inlet port 62, configured in a spaced apart relation with each other within the fluid trench 52 of the fluid jetting chip 50. The inlet ports 60, 62 are joined ports between the fluid trench 52 and the respective channels 106, 108 of the mounting unit 100. The inlet ports 60, 62 are adapted to be fluidly coupled to the channel 106 and the channel 108, respectively for receiving the priming fluid therefrom.

The system also includes at least one second channel, such as a channel 112 and a channel 114 fluidly coupled to the fluid trench 52, that may extend transversely to the fluid trench 52. Each channel of the channels 112, 114 extends vertically between the fluid jetting chip 50 and the mounting unit 100. Specifically, the channels 112, 114 are fan-out microfluidic channels that extend vertically from the mounting unit 100 to the fluid jetting chip 50. The channels 112, 114 are adapted to drain-out the priming fluid from the fluid trench 52 (as shown by directional arrows "D" and "E"). The channels 112, 114 are also fluidly coupled to a fluid storage chamber (not shown). Specifically, a supply fluid channel 116 depicts the fluid coupling between the fluid storage chamber and the channels 112, 114.

Moreover, the system includes at least one outlet port, such as an outlet port 64 and an outlet port 66 configured in a spaced apart relation with each other, within the fluid trench 52 of the fluid jetting chip 50. The outlet ports 64, 66 are adapted to be fluidly coupled to the inlet ports 60, 62, respectively. Further, the outlet ports 64, 66 are adapted to be fluidly coupled to the channels 112, 114, respectively, for draining-out the priming fluid from within the fluid trench 52. The outlet ports 64, 66 are joined ports between the fluid trench 52 and the respective channels 112, 114 of the mounting unit 100. Each outlet port of the outlet ports 64, 66 may include a valve (not shown) adapted to shut the respective channels 112, 114 during a printing mode. In addition, the distance between the inlet ports 60, 62 and the respective outlet ports 64, 66 may range from about 1.5 millimeter (mm) to about 2.2 mm.

Priming of the fluid jetting device 1000 may be performed by circulating a fluid (priming fluid) into the fluid jetting device 1000 using a driving force such as a positive pressure applied at the channels 106, 108 and vacuum pumping at the channels 112, 114. Specifically, the fluid may be forced through the channels 106, 108 from the fluid storage chamber. Subsequently, the fluid may be allowed to circulate into the fluid trench 52. Thereafter, the fluid may be drained-out through the channels 112, 114 in order to remove trapped air bubbles and/or residual fluid from within the fluid jetting device 1000. The priming may be performed periodically to remove the trapped air bubbles and/or residual fluid during servicing of the fluid jetting device 1000.

Figure 3:
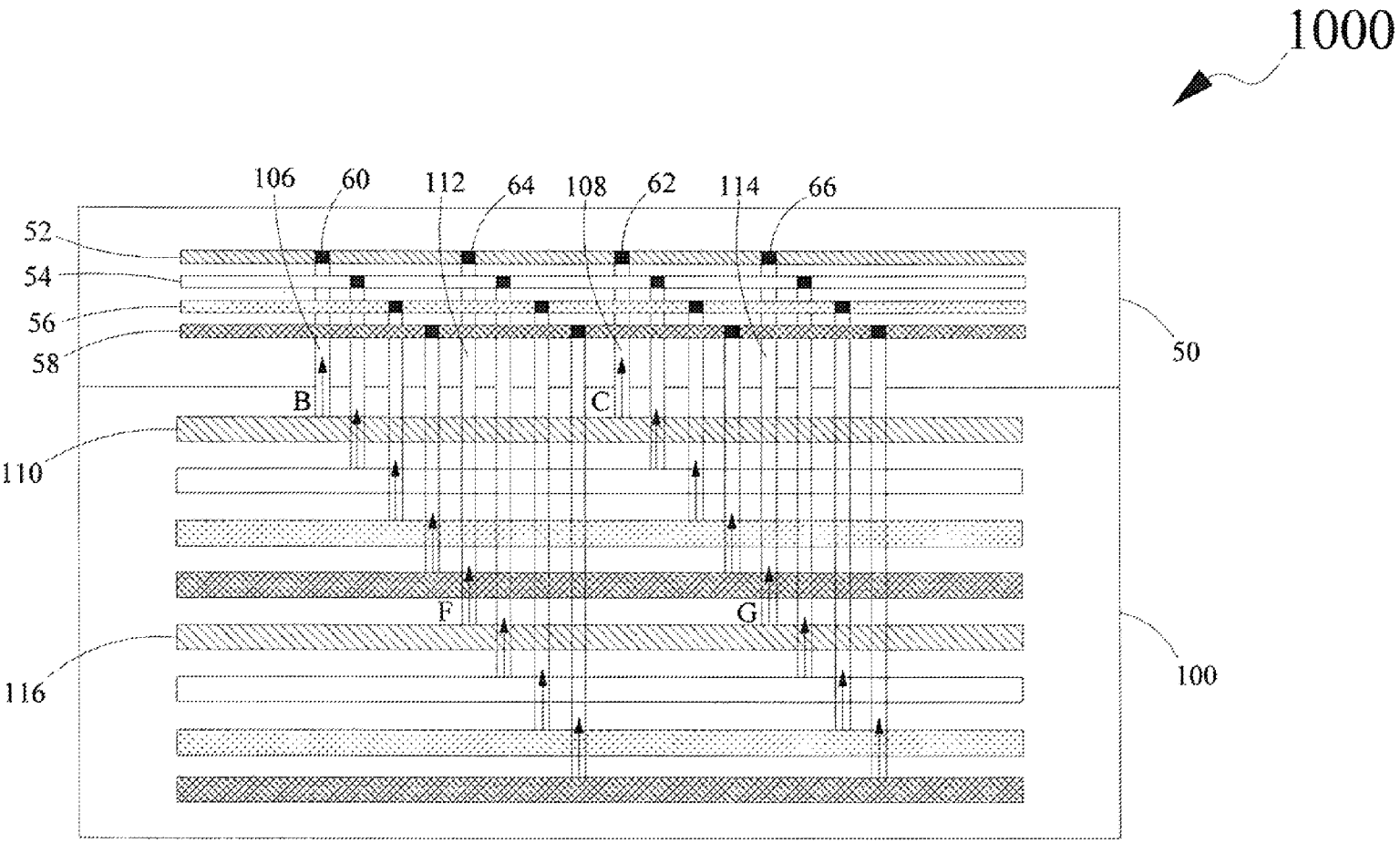
FIG. 3 illustrates the system of FIG. 1 configured at a printing mode.

During the printing mode, the channels 106, 108 and 112, 114 feed inks, and more specifically, inks of different colors, into the fluid jetting chip 50, as shown by directional arrows "B," "C," "F," and "G" in FIG. 3. Specifically, the outlet ports 64, 66 may operate as the inlet ports 60, 62 in order to supply fluids to the fluid trench 52 for printing purposes.

The system of FIG. 1 has been explained with reference to the fluid trench 52 only, and accordingly, components associated with the fluid trenches 54, 56, 58 have not been explained for the sake of brevity. However, it should be understood that each fluid trench of the fluid trenches 54, 56, 58 may include at least one first channel (not numbered), at least one inlet port (not numbered), at least one second channel (not numbered), and at least one outlet port (not numbered). Further, the at least one inlet port and the at least one outlet port may be distributed alternatively and evenly across the fluid jetting chip 50 along a length thereof in order to reduce bubble entrapment within the fluid trenches 54, 56, 58. The at least one channel for the same fluid color may alternatively be connected to two different supply fluid channels (not numbered) along the length of the fluid jetting chip 50. During the priming mode, any pair of neighboring inlet port and outlet port for the same fluid color may have opposite flow directions, i.e., circulation may be formed between such neighboring inlet port and outlet port.

Figure 4:
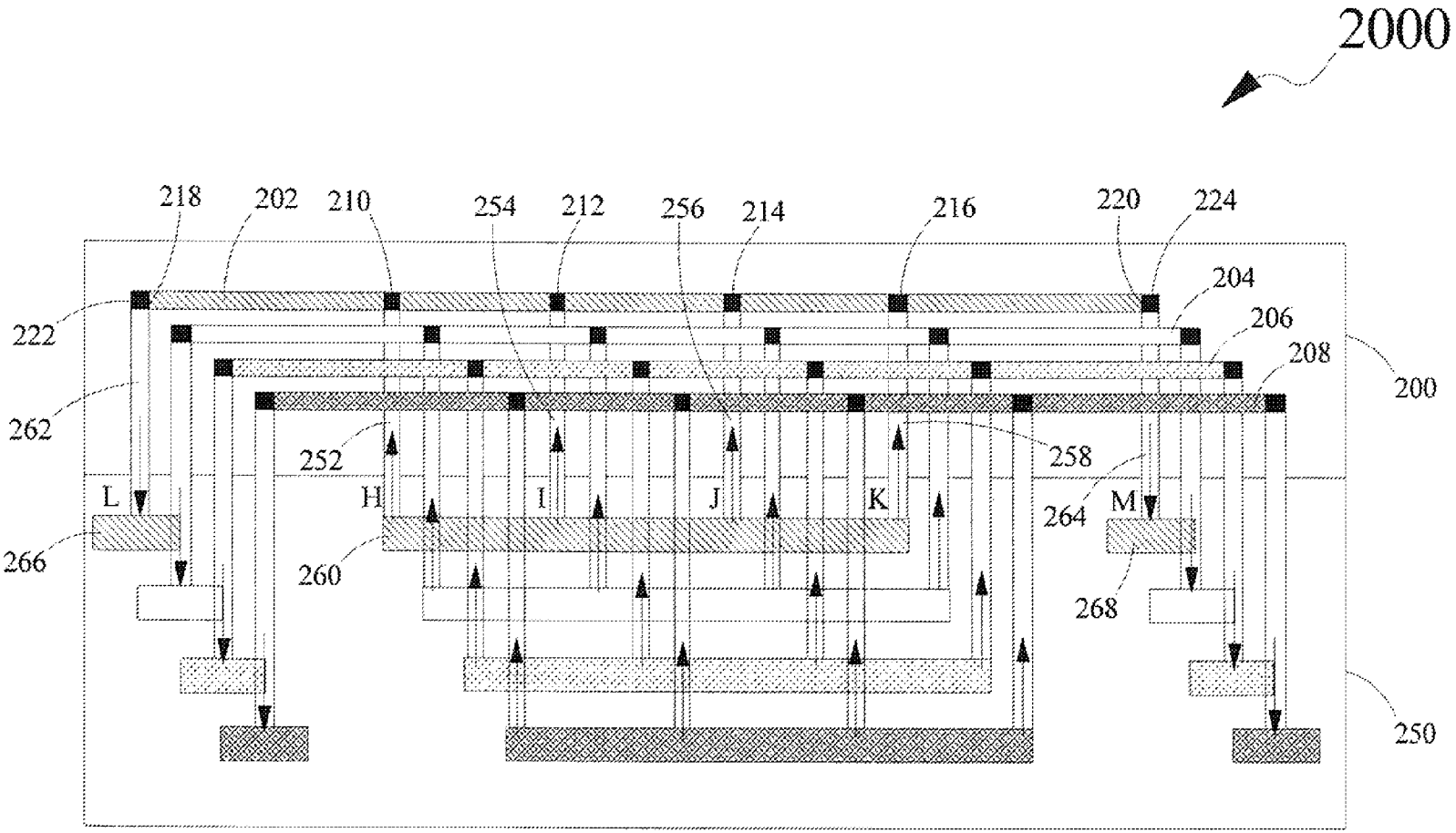
FIG. 4 illustrates a system for priming a fluid jetting device configured at a priming mode, in accordance with another embodiment of the present disclosure.

FIG. 4 illustrates a system for priming a fluid jetting device 2000 configured at a priming mode, in accordance with another embodiment of the present disclosure. The system of FIG. 4 is similar to the system of FIG. 1, and the fluid jetting device 2000 is similar to the fluid jetting device 1000. Specifically, the fluid jetting device 2000 includes a fluid jetting chip 200, a mounting unit 250 adapted to support the fluid jetting chip 200, and a compliant layer (not shown) for covering the fluid jetting chip 200. Specifically, the fluid jetting chip 200 is supported vertically on the mounting unit 250 to connect in height with the mounting unit 250.

The system of FIG. 4 includes a fluid trench 202 configured within the fluid jetting chip 200 of the fluid jetting device 2000. The fluid trench 202 may be for a particular fluid color, such as black. The system also includes other fluid trenches, such as fluid trenches 204, 206, and 208, for fluid colors such as blue, yellow and pink, respectively. The system may also include one or more additional trenches, such as the fluid trench 202 for the same fluid color, such as black.

Further, the system includes at least one first channel, such as a channel 252, a channel 254, a channel 256, and a channel 258, fluidly coupled to the fluid trench 202. The channels 252, 254, 256, 258 are similar to the channels 106, 108 of FIG. 1, and may extend transversely to the fluid trench 202. Further, the channels 252, 254, 256, 258 extend vertically between the fluid jetting chip 200 and the mounting unit 250 of the fluid jetting device 2000. Specifically, the channels 252, 254, 256, 258 are fan-out microfluidic channels that extend vertically from the mounting unit 250 to the fluid jetting chip 200 of the fluid jetting device 2000. The channels 252, 254, 256, 258 are adapted to supply a priming fluid to the fluid trench 202. Further, the channels 252, 254, 256, 258 are fluidly coupled to a fluid storage chamber (not shown). Specifically, a supply fluid channel 260 depicts the fluid coupling between the fluid storage chamber and the channels 252, 254, 256, 258. The term "priming fluid," as used herein, refers to a fluid, such as a flushing solution, used for priming the fluid jetting device 2000.

In addition, the system includes at least one inlet port, such as an inlet port 210, an inlet port 212, an inlet port 214, and an inlet port 216 configured in a spaced apart relation with each other, within the fluid trench 202 of the fluid jetting chip 200. The inlet ports 210, 212, 214, 216 are joined ports between the fluid trench 202 and the respective channels 252, 254, 256, 258 of the mounting unit 250. Further, the inlet ports 210, 212, 214, 216 are adapted to be fluidly coupled to the channels 252, 254, 256, 258, respectively, for receiving the priming fluid (as shown by directional arrows "H," "I" "J" and "K").

The system also includes at least one second channel, such as a channel 262 and a channel 264 fluidly coupled to the fluid trench 202 at respective end portions 218, 220 thereof. Further, the channels 262, 264 may extend transversely to the fluid trench 202. Each channel of the channels 262, 264 extends vertically between the fluid jetting chip 200 and the mounting unit 250. Specifically, the channels 262, 264 are fan-out microfluidic channels extending vertically from the mounting unit 250 to the fluid jetting chip 200. Further, the channels 262, 264 are adapted to drain-out the priming fluid from the fluid trench 202. The channels 262, 264 are also fluidly coupled to a fluid storage chamber (not shown). Specifically, supply fluid channels 266, 268 depict the fluid coupling between the fluid storage chamber and the channels 262, 264, respectively. The channels 262, 264 are separated from the channels 252, 254, 256, 258, and are configured in the same plane of the mounting unit 250. Such an arrangement facilitates in an easy manufacturing of the fluid jetting device 2000.

Moreover, the system includes at least one outlet port, such as an outlet port 222 and an outlet port 224 configured within the fluid trench 202 of the fluid jetting chip 200. Specifically, the outlet ports 222, 224 are configured at the respective end portions 218, 220 of the fluid trench 202. The outlet ports 222, 224 may be adapted to be fluidly coupled to one or more of the inlet ports 210, 212 214, 216. Specifically, the outlet port 222 may be fluidly coupled to the inlet ports 210, 212, and the outlet port 224 may be fluidly coupled to the inlet port 214, 216. Further, the outlet ports 222, 224 are adapted to be fluidly coupled to the channels 262, 264, respectively, for draining-out the priming fluid from within the fluid trench 202 (as shown by directional arrows "L" and "M"). Specifically, the outlet ports 222, 224 are joined ports between the fluid trench 202 and the respective channels 262, 264 of the mounting unit 250. Each outlet port of the outlet ports 222, 224 may include a valve (not shown) adapted to shut the respective channels 262, 264. The valve may be a mechanical valve adapted to the shut the channels 262, 264 during a printing mode. The distance between the inlet ports 210, 212, 214, 216 and the respective outlet ports 222, 224 may range from about 1.5 mm to about 2.2 mm.

Priming of the fluid jetting device 2000 may be performed by circulating a fluid into the fluid jetting device 2000, and specifically, the fluid trench 202, using a driving force such as a positive pressure applied at the channels 252, 254, 256, 258 and by vacuum pumping at the channels 262, 264. Specifically, the fluid may be forcefully fed into the fluid trench 202 through the channels 252, 254, 256, 258 for priming the fluid jetting device 2000. Subsequently, the outlet ports 222, 224 may pull air bubbles and fluid out from the fluid trench 202. The priming may be performed periodically to remove trapped air bubbles and/or residual fluid from within the fluid jetting device 2000 during servicing of the fluid jetting device 2000.

The system of FIG. 4 has been explained with reference to the fluid trench 202 only, and accordingly, components associated with the fluid trenches 204, 206, 208 have not been explained for the sake of brevity. However, it should be understood that each fluid trench of the fluid trenches 204, 206, 208 may include at least one first channel (not numbered), at least one inlet port (not numbered), at least one second channel (not numbered), and at least one outlet port (not numbered).

Figure 5:
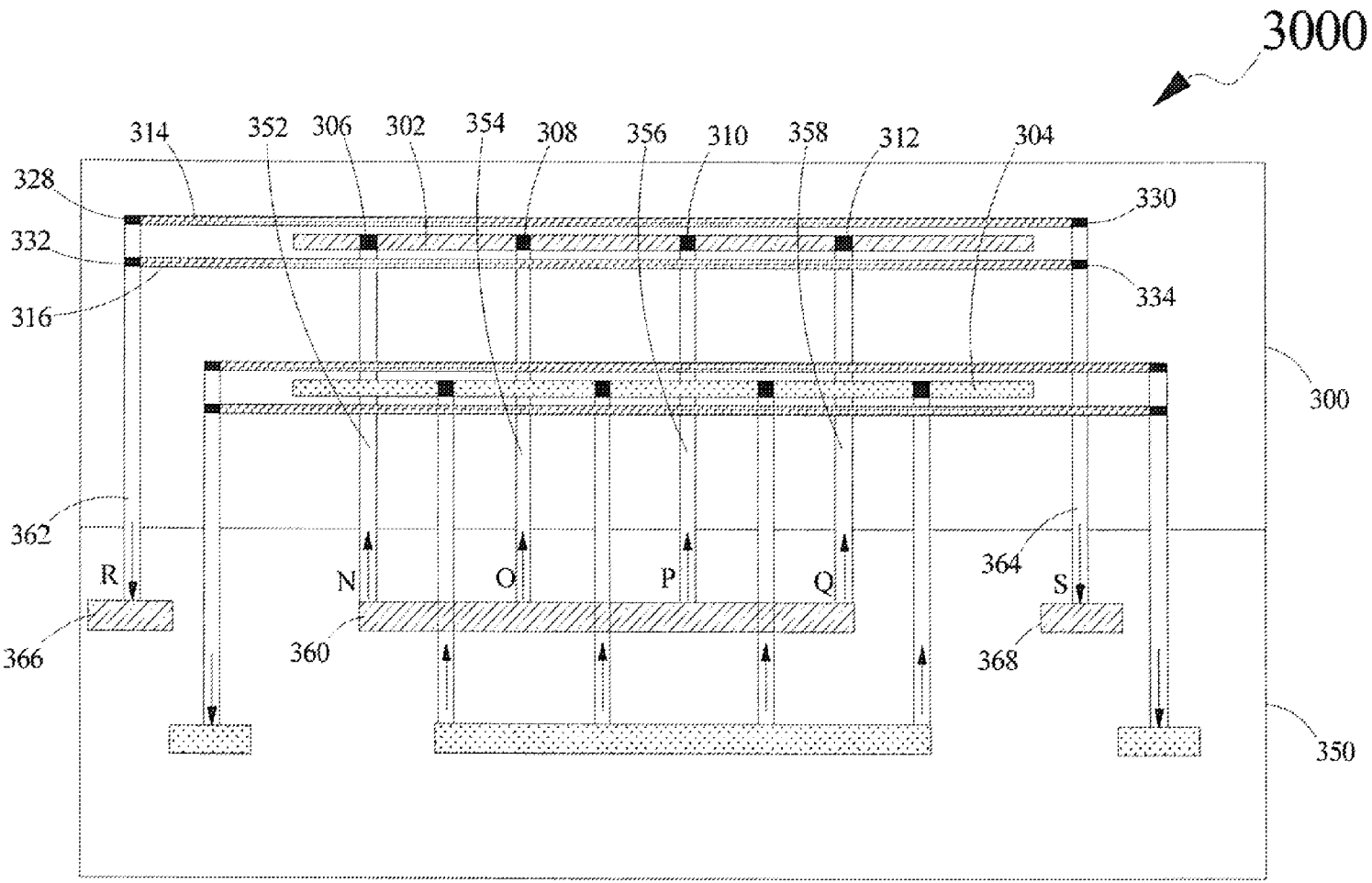
FIG. 5 illustrates a system for priming a fluid jetting device configured at a priming mode, in accordance with yet another embodiment of the present disclosure.

FIG. 5 illustrates a system for priming a fluid jetting device 3000 configured at a priming mode, in accordance with yet another embodiment of the present disclosure. The system of FIG. 5 is similar to the system of FIGS. 1 and 4, and the fluid jetting device 3000 is similar to the fluid jetting devices 1000 and 2000. The fluid jetting device 3000 includes a fluid jetting chip 300, a mounting unit 350 adapted to support the fluid jetting chip 300, and a compliant layer (not shown) for covering the fluid jetting chip 300. Specifically, the fluid jetting chip 300 is supported vertically on the mounting unit 350 to connect in height with the mounting unit 350.

The system of FIG. 5 includes a fluid trench 302 configured within the fluid jetting chip 300 of the fluid jetting device 3000. The fluid trench 302 may be for a particular fluid color, such as black. The system may also include other fluid trenches, such as a fluid trench 304 for a fluid color such as blue. For the purpose of this description, the system of FIG. 5 has been shown to include two fluid trenches. However, it should be understood that the system may include additional fluid trenches either for the same fluid color (such as black and blue) or other fluid colors such as (yellow and pink).

Further, the system includes at least one first channel, such as a channel 352, a channel 354, a channel 356, and a channel 358, fluidly coupled to the fluid trench 302. The channels 352, 354, 356, 358 are similar to the channels 252, 254, 256, 258 of FIG. 4 and may extend transversely to the fluid trench 302. Further, the channels 352, 354, 356, 358 extend vertically between the fluid jetting chip 300 and the mounting unit 350. Specifically, the channels 352, 354, 356, 358 are fan-out microfluidic channels that extend vertically from the mounting unit 350 to the fluid jetting chip 300. Furthermore, the channels 352, 354, 356, 358 are adapted to supply a priming fluid to the fluid trench 302. The channels 352, 354, 356, 358 are also fluidly coupled to a fluid storage chamber (not shown). Specifically, a supply fluid channel 360 depicts the fluid coupling between the fluid storage chamber and the channels 352, 354, 356, 358. The term "priming fluid," as used herein, refers to a fluid, such a flushing solution, used for priming the fluid jetting device 3000.

In addition, the system includes at least one inlet port, such as an inlet port 306, an inlet port 308, an inlet port 310 and an inlet port 312 configured in a spaced apart relation with each other, within the fluid trench 302 of the fluid jetting chip 300. The inlet ports 306, 308, 310, 312 are joined ports between the fluid trench 302 and the respective channels 352, 354, 356, 358 of the mounting unit 350. The inlet ports 306, 308, 310, 312 are adapted to be fluidly coupled to the channels 352, 354, 356, 358, respectively for receiving the priming fluid (as shown by directional arrows "N," "O," "P" and "Q").

Figure 6:
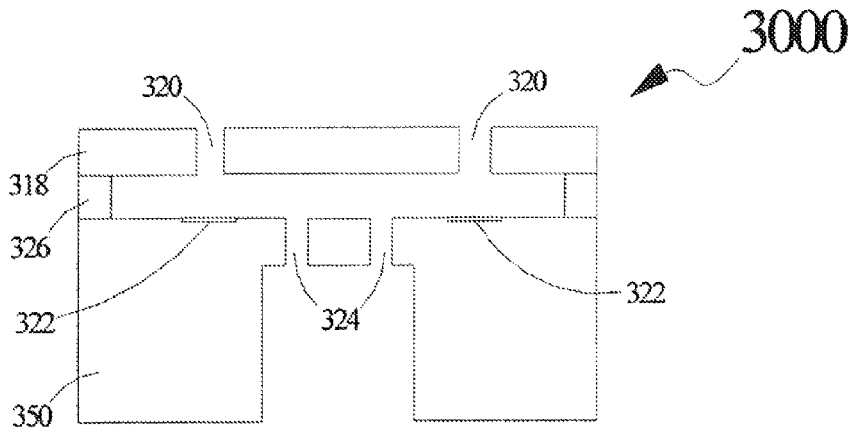
FIG. 6 is a cross-sectional view of the fluid jetting device employing the system of FIG. 5, illustrating an arrangement of a nozzle plate, a flow feature layer, and a mounting unit of the fluid jetting device.
Figure 7:
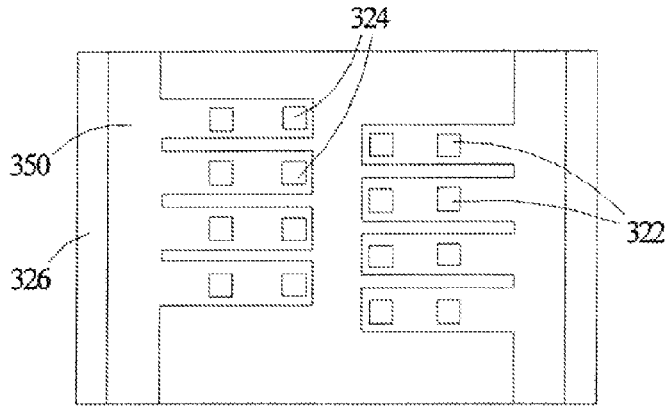
FIG. 7 is a top view of the fluid jetting device of FIG. 6, illustrating the arrangement of the flow feature layer and the mounting unit.
Figure 8:
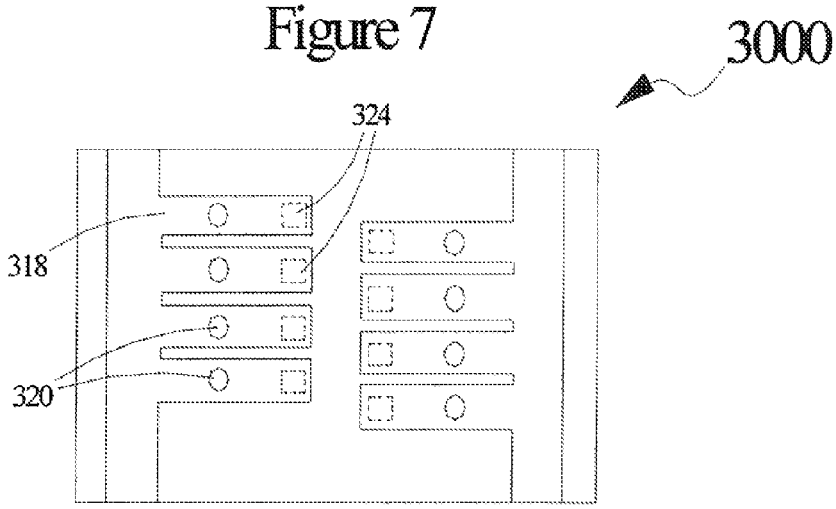
FIG. 8 is a top view of the fluid jetting device of FIG. 6, illustrating the arrangement of the nozzle plate, the flow feature channel layer, and the mounting unit.

The system also includes at least one flow feature channel, such as a flow feature channel 314 and a flow feature channel 316 disposed adjacent to the fluid trench 302 and adapted to be fluidly coupled to the fluid trench 302. Specifically, the fluid trench 302 may be associated with one or more parallel rows of nozzles (not shown) configured on a nozzle plate (not shown) of the fluid jetting chip 300. Each row of the nozzles may have a single flow feature channel, such as the flow feature channel 314. FIGS. 6-8 illustrate the fluid jetting device 3000 employing the system of FIG. 5. Specifically, FIGS. 6-8 illustrate an arrangement of a nozzle plate 318 having a plurality of nozzles 320; a plurality of heaters 322 with double chokes (not shown); a plurality of 'Wiley holes' 324; a flow feature layer 326 having the flow feature channels 314, 316; and the mounting unit 350 of the fluid jetting device 3000. The employment of the flow feature channels 314, 316 requires the use of a wider chip. Accordingly, the fluid jetting chip 300 is wider than the fluid jetting chip 50 and the fluid jetting chip 200 of FIGS. 1 and 4. Each heater of the heaters 322 may have a first choke towards a hole of the 'Wiley holes' 324, and a second choke towards a flow feature channel, such as the flow feature channel 314.

Referring again to FIG. 5, the system also includes at least one second channel, such as a channel 362 and a channel 364. The channels 362, 364 are fluidly coupled to each flow feature channel of the flow feature channels 314, 316. Specifically, the channel 362 may be fluidly coupled to the flow feature channels 314, 316 at respective first end portions (not numbered) thereof. Similarly, the channel 364 may be fluidly coupled to the flow feature channels 314, 316 at respective second end portions (not numbered) thereof opposite to the respective first end portions. Further, the channels 362, 364 may extend transversely to the flow feature channels 314, 316. Each channel of the channels 362, 364 extends vertically between the fluid jetting chip 300 and the mounting unit 350. Specifically, the channels 362, 364 are fan-out microfluidic channels that extend vertically from the mounting unit 350 to the fluid jetting chip 300. The channels 362, 364 are adapted to drain-out the priming fluid from the flow feature channels 314, 316. Further, the channels 362, 364 are also fluidly coupled to a fluid storage chamber (not shown). Specifically, supply fluid channels 366, 368 depict the fluid coupling between the fluid storage chamber and the channels 362, 364, respectively. The channels 352, 354, 356, 358 are separated from the channels 362, 364, and are configured in the same plane of the mounting unit 350. Such an arrangement facilitates in an easy manufacturing of the fluid jetting device 3000.

Moreover, the system includes at least one outlet port, such as an outlet port 328, an outlet port 330 configured within the flow feature channel 314 of the fluid jetting chip 300. Specifically, the outlet ports 328, 330 may be configured respectively at a first end portion (not numbered) and a second end portion (not numbered) opposite to the first end portion of the flow feature channel 314. The outlet ports 328, 330 are adapted to be fluidly coupled to one or more inlet ports of the inlet ports 306, 308, 310, 312. Specifically, the outlet port 328 may be fluidly coupled to the inlet ports 306, 308, and the outlet port 330 may be fluidly coupled to the inlet ports 310, 312. Further, the outlet ports 328, 330 are adapted to be fluidly coupled to the channels 362, 364 for draining-out the priming fluid along with air bubbles from within the fluid trench 302 and the flow feature channel 314 (as shown by directional arrows "R" and "S"). The outlet ports 328, 330 are joined ports between the flow feature channel 314 and the respective channels 362, 364 of the mounting unit 350. Each outlet port of the outlet ports 328, 330 may include a valve (not shown) adapted to shut the respective channels 362, 364. The valve may be a mechanical valve adapted to shut the channels 362, 364 during a printing mode. The distance between the inlet ports 306, 308, 310, 312 and the respective outlet ports 328, 330 may range from about 1.5 mm to about 2.2 mm.

Similarly, the system includes at least one outlet port, such as an outlet port 332, an outlet port 334 configured within the flow feature channel 316 of the fluid jetting chip 300. Specifically, the outlet ports 332, 334 may be configured respectively at a first end portion (not numbered) and a second end portion (not numbered) opposite to the first end portion of the flow feature channel 316. The outlet ports 332, 334 are adapted to be fluidly coupled to the one or more inlet ports of the inlet ports 306, 308, 310, 312. Specifically, the outlet port 332 may be fluidly coupled to the inlet ports 306, 308, and the outlet port 334 may be fluidly coupled to the inlet ports 310, 312. Further, the outlet ports 332, 334 are adapted to be fluidly coupled to the channels 362, 364 for draining-out the priming fluid along with air bubbles from within the fluid trench 302 and the flow feature channel 316 (as shown by directional arrows "R" and "S"). The outlet ports 332, 334 are joined ports between the flow feature channel 316 and the respective channels 362, 364 of the mounting unit 350. Each outlet port of the outlet ports 332, 334 may include a valve (not shown) adapted to shut the respective channels 362, 364. The valve may be a mechanical valve adapted to shut the channels 362, 364 during the printing mode. The distance between the inlet ports 306, 308, 310, 312 and the respective outlet ports 332, 334 may range from about 1.5 mm to about 2.2 mm.

Priming of the fluid jetting device 3000 may be performed by circulating a fluid into the fluid jetting device 3000, and specifically, the fluid trench 302, and the flow feature channels 314, 316. Further, priming may be performed by feeding the fluid into the fluid jetting device 3000 using a driving force such as a positive pressure applied at the channels 352, 354, 356, 358 and by vacuum pumping at the channels 362, 364. Accordingly, the fluid may be circulated through the channels 352, 354, 356, 358, the fluid trench 302, the flow feature channels 314, 316 and the channels 362, 364 for priming the fluid jetting device 3000. Specifically, the channels 352, 354, 356, 358 feed fluid into the fluid trench 302 that passes through the flow feature channels 314, 316. Further, the outlet ports 328, 330, 332, 334 pull air bubbles and fluid out from the fluid trench 302 and the flow feature channels 314, 316. Such a system facilitates in circulating the priming fluid through fluid firing chambers (not shown) that encompass the flow feature channels 314, 316 and are coupled to the nozzle plate 318 (as shown in FIGS. 6 and 8) of the fluid jetting device 3000. The priming may be performed periodically to remove trapped air bubbles during servicing of the fluid jetting device 3000.

As mentioned above, the system may also include other fluid trenches, such as the fluid trench 304, which may include at least one first channel (not numbered), at least one inlet port (not numbered), at least one flow feature channel (not numbered), at least one second channel (not numbered), and at least one outlet port (not numbered). However, the system of FIG. 5 has been explained with reference to the fluid trench 302 only, and accordingly, components associated with other fluid trench have not been explained for the sake of brevity.

Figure 9:
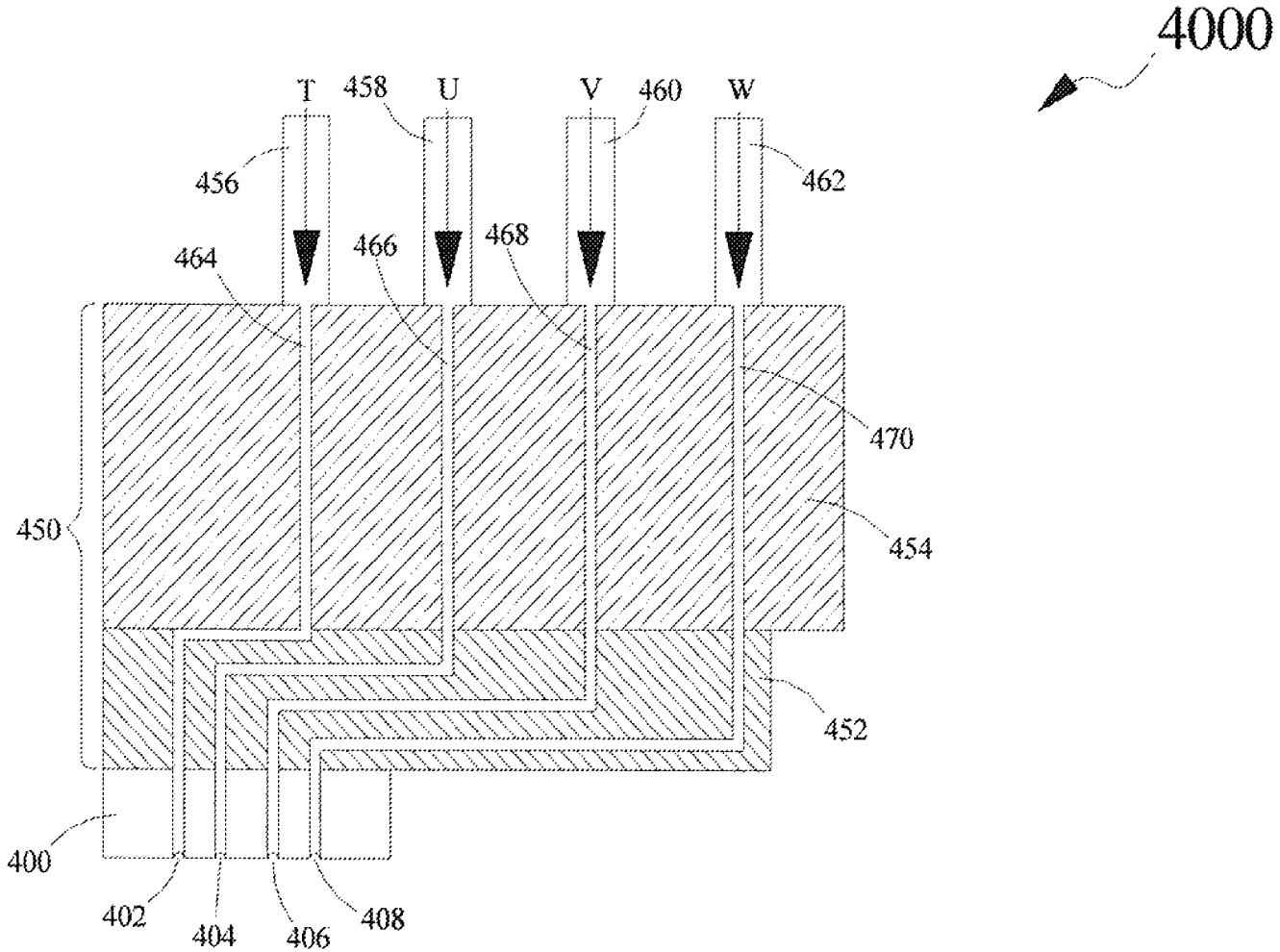
FIG. 9 illustrates a system for priming a fluid jetting device, in accordance with still another embodiment of the present disclosure.

FIG. 9 illustrates a system for priming a fluid jetting device 4000, in accordance with still another embodiment of the present disclosure. The fluid jetting device 4000 is similar to the fluid jetting device 1000 and includes a fluid jetting chip 400, and a mounting unit 450 adapted to support the fluid jetting chip 400. Specifically, the fluid jetting chip 400 is supported vertically on the mounting unit 450 to connect in height with the mounting unit 450. The mounting unit 450 includes a fluidic tile 452 disposed on a base 454. Further, the fluid jetting device 4000 may include a compliant layer (not shown) for covering the fluid jetting chip 400. Further, the fluid jetting device 4000 may be a dry fluid jetting device.

The system includes at least one feeding member, such as a feeding member 456, a feeding member 458, a feeding member 460, and a feeding member 462, coupled to the mounting unit 450. The system further includes at least one first fluid channel, such as a fluid channel 464, a fluid channel 466, a fluid channel 468, and a fluid channel 470, configured within the fluid jetting device 4000. The fluid channels 464, 466, 468, 470 are adapted to be fluidly coupled with the feeding members 456, 458, 460, 462, respectively, to receive a priming fluid (as shown by directional arrows "T", "U," "V" and "W"). The priming fluid is a flushing solution. The flushing solution as used herein may be a solution of a surfactant in water that is capable of improving wetting capability of various components, such as flow feature channels (not shown), firing chambers (not shown), and the like, of the fluid jetting device 4000. Alternatively, the priming fluid may be any solution known in the art that may be used for priming of the fluid jetting device 4000.

Furthermore, the system includes at least one draining member, such as a draining member 402, a draining member 404, a draining member 406, and a draining member 408, fluidly coupled to the fluid channels 464, 466, 468, 470, respectively, to drain-out the priming fluid from within the fluid jetting device 4000. The draining members 402, 404, 406, 408 are nozzles of a nozzle plate (not shown) that may be attached to/integral to the fluid jetting chip 400 of the fluid jetting device 4000.

As shown in FIG. 9, the feeding members 456, 458, 460, 462 are used to flush in the priming fluid into the fluid channels 464, 466, 468, 470. The priming fluid may then be allowed to be spitted-out through the draining members 402, 404, 406, 408. Subsequently, the feeding members 456, 458, 460, 462 are provided with inks to push the priming fluid out through the draining members 402, 404, 406, 408. The priming fluid may optionally be evacuated by clean air just before feeding the inks through the feeding members 456, 458, 460, 462. Subsequently, the inks are fed-in to replace the priming fluid until the priming fluid purges out of the fluid jetting device 4000 completely.

Figure 10:
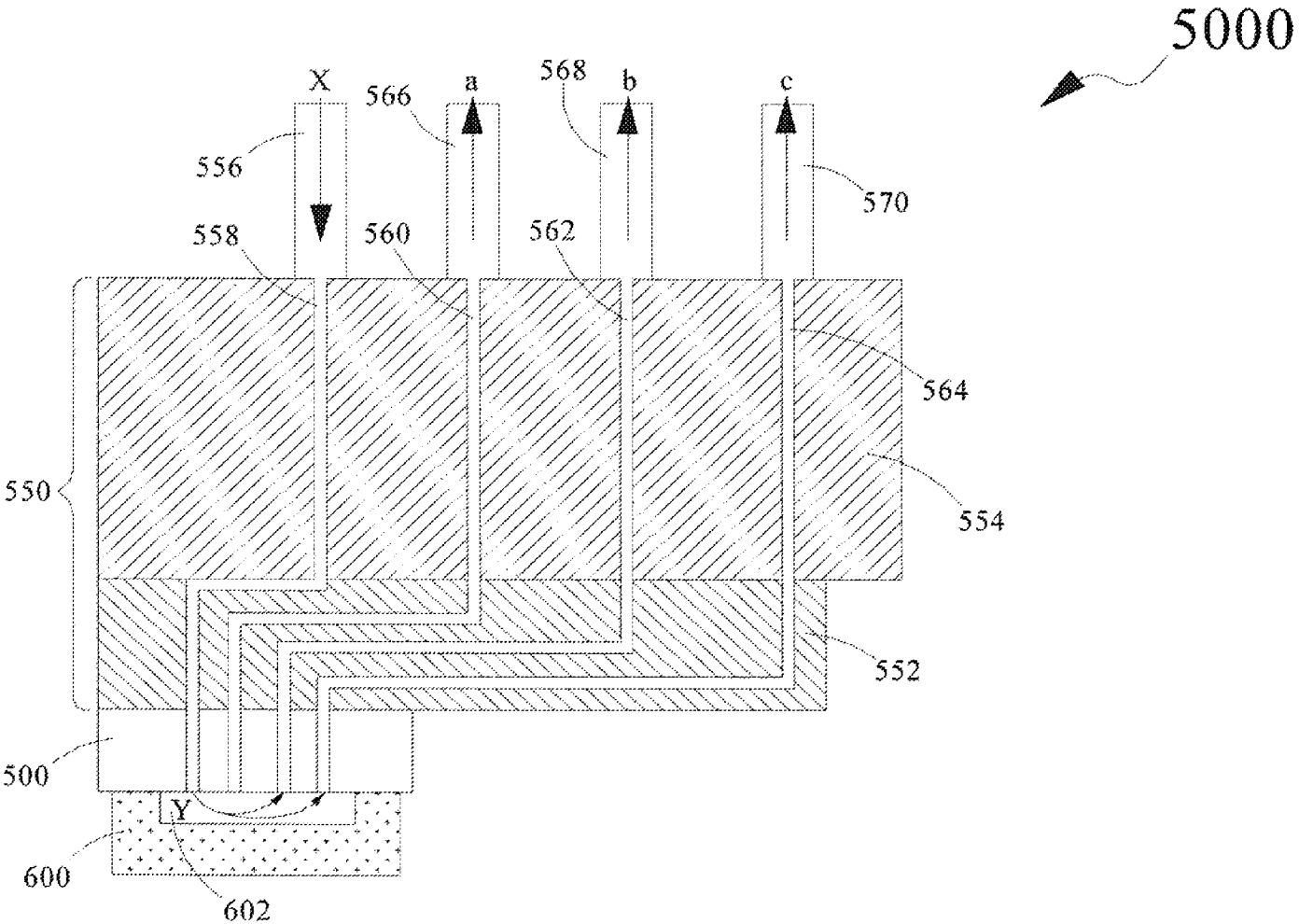
FIG. 10 illustrates a system for priming a fluid jetting device, in accordance with still another embodiment of the present disclosure.

FIG. 10 illustrates a system for priming a fluid jetting device 5000, in accordance with still another embodiment of the present disclosure. The fluid jetting device 5000 is similar to the fluid jetting device 4000 and includes a fluid jetting chip 500, a mounting unit 550 adapted to support the fluid jetting chip 500, and a compliant layer 600 for covering the fluid jetting chip 500. Specifically, the fluid jetting chip 500 is supported vertically on the mounting unit 550 to connect in height with the mounting unit 550. The mounting unit 550 includes a fluidic tile 552 disposed on a base 554. The complaint layer 600 forms a cap over the fluid jetting chip 500 and a rim (not shown) of the complaint layer 600 is sealed against the fluid jetting chip 500 outside an area (not shown) encompassing one or more nozzles of the fluid jetting device 5000. Further, the fluid jetting device 5000 may be a dry fluid jetting device.

The system includes at least one feeding member, such as a feeding member 556 coupled to the mounting unit 550. The system further includes at least one first fluid channel, such as a fluid channel 558, configured within the fluid jetting device 5000. The fluid channel 558 is adapted to be fluidly coupled with the feeding member 556 to receive a priming fluid (as shown by a directional arrow "X"). The feeding member 556, as shown in FIG. 10, may be a gasket connector.

The priming fluid is a flushing solution. The flushing solution as used herein may be a solution of a surfactant in water that is capable of improving wetting capability of various components, such as flow feature channels (not shown), firing chambers (not shown), and the like, of the fluid jetting device 5000. Alternatively, the priming fluid may be any solution known in the art that may be used for priming of the fluid jetting device 5000.

Furthermore, the system includes a trench 602 configured within the compliant layer 600. The trench 602 is fluidly coupled to the fluid channel 558 for receiving the priming fluid. The system also includes at least one second fluid channel, such as a fluid channel 560, a fluid channel 562, and a fluid channel 564, configured within the fluid jetting device 5000 and fluidly coupled to the trench 602 for receiving the priming fluid (as shown by directional arrow "Y").

In addition, the system includes at least one draining member, such as a draining member 566, a draining member 568, and a draining member 570, fluidly coupled to the fluid channels 560, 562, 564, respectively, to drain-out the priming fluid from within the fluid jetting device 5000 (as shown by directional arrows "a," "b" and "c"). The draining members 566, 568, 570, as shown in FIG. 10, may be gasket connectors coupled to the mounting unit 550.

The priming fluid may be provided to the feeding member 556. Subsequently, the priming fluid is allowed to pass to the trench 602 of the compliant layer 600 through the fluid channel 558 and one or more nozzles (not shown) fluidly coupled to the fluid channel 558. Accordingly, the priming fluid flows through regular fluid paths of the fluid jetting device 5000. The priming fluid then fills the trench 602 on the compliant layer 600. Subsequently, the priming fluid is allowed to flow back to the fluid channels 560, 562, 564 and is drained-out via the draining members 566, 568, 570. Thereafter, the feeding member 556 and the draining members 566, 568, 570 are provided with inks to push the priming fluid out through the one or more nozzles. Specifically, colored inks may be fed into the feeding member 556 and the draining members 566, 568, 570. The priming fluid may optionally be evacuated by clean air just before feeding the inks through the feeding member 556 and the draining members 566, 568, 570 without loss of wetting capability of the fluid channels 558, 560, 562, 564. Subsequently, ink is fed-in to replace the priming fluid until the priming fluid purges out of the fluid jetting device 5000 completely.

The present disclosure provides systems for priming fluid jetting devices, such as the fluid jetting devices 1000-5000. The systems of the present disclosure facilitate fluid recirculation through a respective fluid jetting chip and a mounting unit arranged in a vertical relation with each other. Specifically, the systems facilitate fluid recirculation at a level encompassing fan-out microfluidic channels that extend vertically between the fluid jetting chip and the mounting unit of the fluid jetting devices in order to remove trapped air bubbles therewithin and within other components, such as fluid trenches, of the fluid jetting devices. Such systems are capable of removing trapped air bubbles from within the fluid jetting devices in order to exhibit high print quality.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. A system for priming a fluid jetting device, the system comprising:

a fluid trench configured within a fluid jetting chip of the fluid jetting device;

at least one flow feature channel disposed adjacent to the fluid trench and adapted to be fluidly coupled to the fluid trench;

a plurality of first channels fluidly coupled to the fluid trench and extending vertically between the fluid jetting chip and a mounting unit adapted to support the fluid jetting chip; and a plurality of second channels fluidly coupled to one or more flow feature channels of the at least one flow feature channel and extending vertically between the fluid jetting chip and the mounting unit, wherein each of the plurality of first channels alternate locations along the fluid trench with each of the plurality of second channels, wherein said each of the plurality of first channels are adapted to supply a priming fluid to the fluid trench, and wherein said each of the plurality of second channels are adapted to drain-out the priming fluid from within the one or more channels of the at least one flow feature channel thereby forming opposite fluid flow directions between the plurality of first channels and the plurality of second channels and forming a plurality of circulation flow paths of fluid between neighboring ones of the plurality of first channels and the plurality of second channels.

2. The system of claim 1, wherein said each of the plurality of first channels are fluidly coupled to a fluid storage chamber.

3. The system of claim 1, wherein said each of the plurality of second channels are fluidly coupled to a fluid storage chamber.

4. The system of claim 1, further comprising:

a plurality of inlet ports configured within the fluid trench of the fluid jetting chip, each of the inlet ports adapted to be fluidly coupled to one of the plurality of first channels for receiving the priming fluid and supplying the priming fluid to the fluid trench; and a plurality of outlet ports configured within each flow feature channel of the one or more flow feature channels, each of the outlet ports adapted to be fluidly coupled to neighboring ones of the plurality of inlet ports, further the each of the outlet ports adapted to be fluidly coupled to one of the plurality of second channels for draining-out the priming fluid.

5. The system of claim 4, wherein the plurality of inlet ports are configured in a spaced apart relation with each other within the fluid trench, and wherein the each of the outlet ports is configured at an end portion of a respective flow feature channel of the one or more flow feature channels.

* * * * *